US006484542B1

(12) United States Patent
Klingler

(10) Patent No.: US 6,484,542 B1
(45) Date of Patent: Nov. 26, 2002

(54) DOOR HANDLE LOCK

(76) Inventor: Gregory Lee Klingler, 824 E. Iowa Ave., Denver, CO (US) 80210

( * ) Notice: Subject to any disclaimer, the term of this patent is extended or adjusted under 35 U.S.C. 154(b) by 0 days.

(21) Appl. No.: 09/882,847

(22) Filed: Jun. 18, 2001

Related U.S. Application Data

(60) Provisional application No. 60/213,874, filed on Jun. 26, 2000.

(51) Int. Cl.[7] ..... E05B 13/00

(52) U.S. Cl. ..... 70/208; 70/202; 70/211; 292/288

(58) Field of Search ..... 70/14, 208, 202, 70/203, 210–212, DIG. 58; 292/288, 291, 296, 297, DIG. 31

(56) References Cited

U.S. PATENT DOCUMENTS

| | | | | | |
|---|---|---|---|---|---|
| 2,049,860 | A | * | 8/1936 | Olson | 70/14 |
| 2,578,547 | A | * | 12/1951 | Hilger | 70/14 X |
| 2,597,583 | A | * | 5/1952 | Holmsten | 70/211 |
| 2,734,373 | A | * | 2/1956 | Scherbinski | 70/211 |
| 3,014,747 | A | * | 12/1961 | Nichols | 292/294 |
| 3,938,839 | A | * | 2/1976 | Collier | 292/288 X |
| 4,065,160 | A | * | 12/1977 | Gilmore, Jr. | 292/288 X |
| 4,302,045 | A | * | 11/1981 | McAdams, Sr. | 292/DIG. 5 X |
| 4,450,695 | A | * | 5/1984 | Graziano | 70/168 |
| 4,506,527 | A | | 3/1985 | Grill | 70/14 |
| 4,640,109 | A | * | 2/1987 | Schaublin et al. | 70/211 X |
| 4,993,248 | A | * | 2/1991 | Nordberg | 70/211 X |
| 5,303,971 | A | * | 4/1994 | Johnsen et al. | 70/211 X |
| 5,325,685 | A | | 7/1994 | Frank | 70/14 |
| 5,791,174 | A | | 8/1998 | Fitzgerald et al. | 70/212 |
| 5,819,561 | A | | 10/1998 | Blehi | 70/14 |
| 5,842,359 | A | | 12/1998 | Longueira | 70/14 |
| 6,058,748 | A | * | 5/2000 | Beals, Jr. et al. | 70/203 |
| 6,427,502 | B1 | * | 8/2002 | Zagoroff | 70/208 |

FOREIGN PATENT DOCUMENTS

| | | | | |
|---|---|---|---|---|
| DE | 397069 | * | 6/1924 | 70/211 |
| FR | 1432048 | * | 2/1966 | 70/211 |
| GB | 6832 | * | 5/1835 | 70/211 |
| GB | 2240360 | * | 7/1991 | 70/14 |

* cited by examiner

*Primary Examiner*—Lloyd A. Gall

(57) ABSTRACT

A door handle lock (20) for hinged lever-style door handles (10) adapted for mounting on a portion of a hinged lever-style door handle (10) and overlapping a portion of a door handle housing (12), the door handle housing (12), with a hinged lever-style door handle (10), is received in a portion of a door, the hinged lever-style door handle (10) used for opening the door. With the door handle lock (20) in place on the hinged lever-style door handle (10), the door cannot be opened because the handle cannot be moved. Attempts to move the door handle (10) are unsuccessful because the door handle lock (20) interferes with the door handle housing (12) if one attempts to move the handle (10), thus preventing movement thereof.

5 Claims, 2 Drawing Sheets

DOOR HANDLE LOCK

CROSS-REFERENCE TO RELATED APPLICATIONS

This application is entitled to the benefit of Provisional Patent Application Ser. No. 60/213,874 filed Jun. 26, 2000.

STATEMENT REGARDING FEDERALLY SPONSORED RESEARCH AND DEVELOPMENT

Not applicable.

BACKGROUND—FIELD OF INVENTION

This invention relates to a door handle lock and more particularly, but not by way of limitation, to a door handle lock adapted for engaging a portion of a door handle and overlapping a portion of a door handle housing and preventing the movement of the door handle and thus unauthorized opening of the door.

BACKGROUND—DESCRIPTION OF PRIOR ART

In U.S. Pat. No. 5,842,359 an anti-theft auxiliary lock for mounting on the side of a vehicle door is disclosed. This lock is used in conjunction with a vehicle's door lock and is not used for mounting on a door handle.

In U.S. Pat. No. 5,791,174 to Fitzgerald et. al., a paddle handle lock is described. The paddle handle lock is designed to be received around a push-pull paddle-style door handle. While the paddle handle lock has similarities to the subject invention in that it prevents unauthorized entry by locking the door handle such that it cannot be moved, it is designed for a different type of door handle than that of the subject invention and, in fact, would not work on the door handle type of the subject invention. Fitzgerald's patent relates to a push-pull paddle-style door handle and requires significant spatial access behind the handle in order to install the lock As will be explained fully hereinafter, the subject invention relates to a hinged lever-style door handle that is contained within a door handle housing. The hinged lever-style door handle is not the push-pull type as described by Fitzgerald and the door handle housing, related to the subject invention, blocks the access that would be needed to install a lock of the type disclosed in Fitzgerald's patent. Further, the shape of the hinged lever-style handle applicable to the subject invention prevents the installation of a lock of the type disclosed by Fitzgerald.

U.S. Pat. No. 5,303,971 to Johnsen et al. describes a tailgate release handle security device. The device taught by Johnsen et al. would not work on the type of handle for which the subject invention is designed. The device of Johnsen et al. requires hooks which fit through apertures in the tailgate handle housing to engage the back side of the tailgate outer panel. The device of the present invention utilizes no hooks or other attachment mechanism and does not require access through any aperture in the housing handle.

U.S. Pat. No. 4,506,527 to Grill, U.S. Pat. No. 5,325,685 to Frank and U.S. Pat. No. 5,819,561 to Blehi describe different types of door lock assemblies and auxiliary door locks. None of these locks are designed to lock the door handle itself, such that it cannot be used to open the door.

The door locks, described in the above mentioned patents, do not disclose, teach or illustrate the unique structure, function and advantage of the subject door handle lock.

SUMMARY

The essence of the present invention is a door handle lock for use on a hinged lever-style door handle contained within a door handle housing. The door handle lock locks the door handle in position relative to the door handle housing such that the door handle cannot be moved, thus preventing unauthorized entry.

OBJECTS AND ADVANTAGES

In view of the foregoing, it is a primary object of the subject invention to provide a door handle lock adapted for mounting on a portion of a hinged lever-style door handle and overlapping a door handle housing mounted in a portion of a door. The type of door handle for which the subject invention applies, herein referred to as a hinged lever-style door handle, is comprised of a paddle type handle, usually flat, pivotally mounted on a hinge pin. The hinge pin is positioned such that, when the door handle is actuated, the ends of the handle move in opposite directions, much like a teeter-totter, with one end moving away from the door and the other end moving deeper inward to the door handle housing. The paddle type handle is usually flush with or below the outer perimeter of the door handle housing. The door handle lock is designed to prevent the movement of the door handle hinged inside the door handle housing and prevent the unauthorized opening of the door.

Another object of the invention is the door handle lock is easy to operate, simple in design, rugged in structure and can be quickly mounted on a door handle.

Still another object of the invention is the door handle lock is adaptable to various types and sizes of hinged lever-style door handles to prevent the movement thereof and prevent the opening of the door. A preferred embodiment of the subject invention requires no tools to secure the door handle lock to the door handle. The door handle lock may be removable or permanently attached to the door handle.

In one embodiment, the door handle lock includes a lock cylinder centered on and mounted inside a lock cylinder block. The lock cylinder block having a front, a rear and sides. The lock cylinder includes a lock face with a key slot for receiving a lock key. The lock face is disposed in the front of the lock cylinder block. Also, the lock cylinder includes a lock cam extending outwardly from the rear of the lock cylinder block. The lock cylinder block includes a pair of block guide pins disposed next to the lock cam. In operation, the block guide pins and lock cam are inserted into a small space between a door handle housing and an end of a door handle. The block guide pins are used for guiding and positioning the lock cylinder block with respect to the door handle and the door handle housing, When the key is received in the key slot and turned, the "L" shaped lock cam is rotated for engaging a portion of a back side of the door handle and holding the lock cylinder block against the door handle housing and the door handle. The lock cam thus holds the door handle against the lock cylinder block and, since the lock cylinder block overlaps a portion of the door handle housing, with the lock cylinder block held in place the door handle is prevented from pivoting and thus prevented from use in opening the door. Once the lock cam has been rotated so as to engage a portion of the back side of the door handle, the block guide pins ensure that the lock cylinder block cannot be rotated or otherwise moved such that the lock cam could be positioned other than engaging a portion of the back side of the door handle.

These and other objects of the subject invention will become apparent to those familiar with the different types of door locks when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

DRAWING FIGURES

The accompanying drawings illustrate complete preferred embodiments of the present invention according to the best modes presently devised for the practical application of the principles thereof, and in which.

Figure 3:
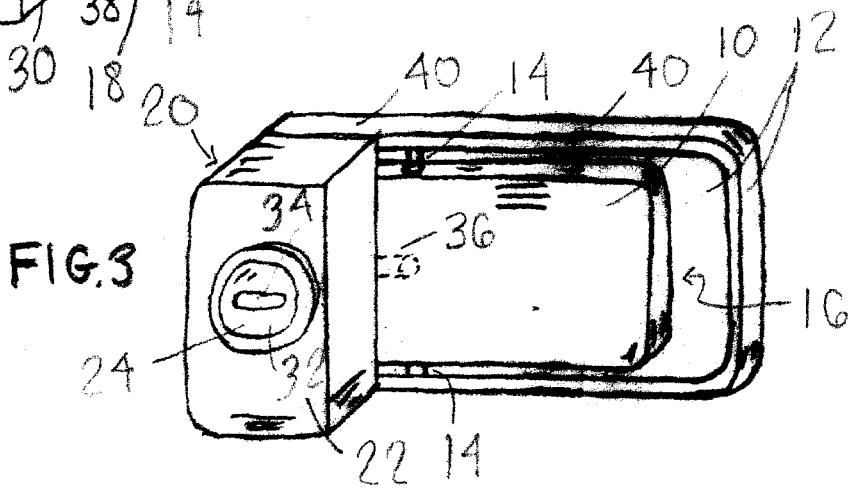

FIG. 3 is another perspective view of the door handle lock with the lock cylinder block attached to the front portion of the door handle and overlapping a front portion of the door handle housing. A key has been used in the lock cylinder to rotate a lock cam. The lock cam, shown in dotted lines, has engaged a back portion of the door handle for securing the lock cylinder block thereon.

Figure 4:
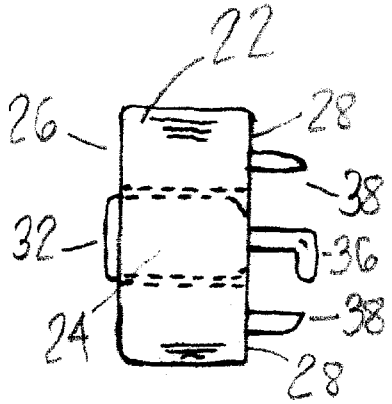

FIG. 4 is a side view of the lock cylinder block, the lock cylinder, the lock cam and two block guide pins.

Figure 5:
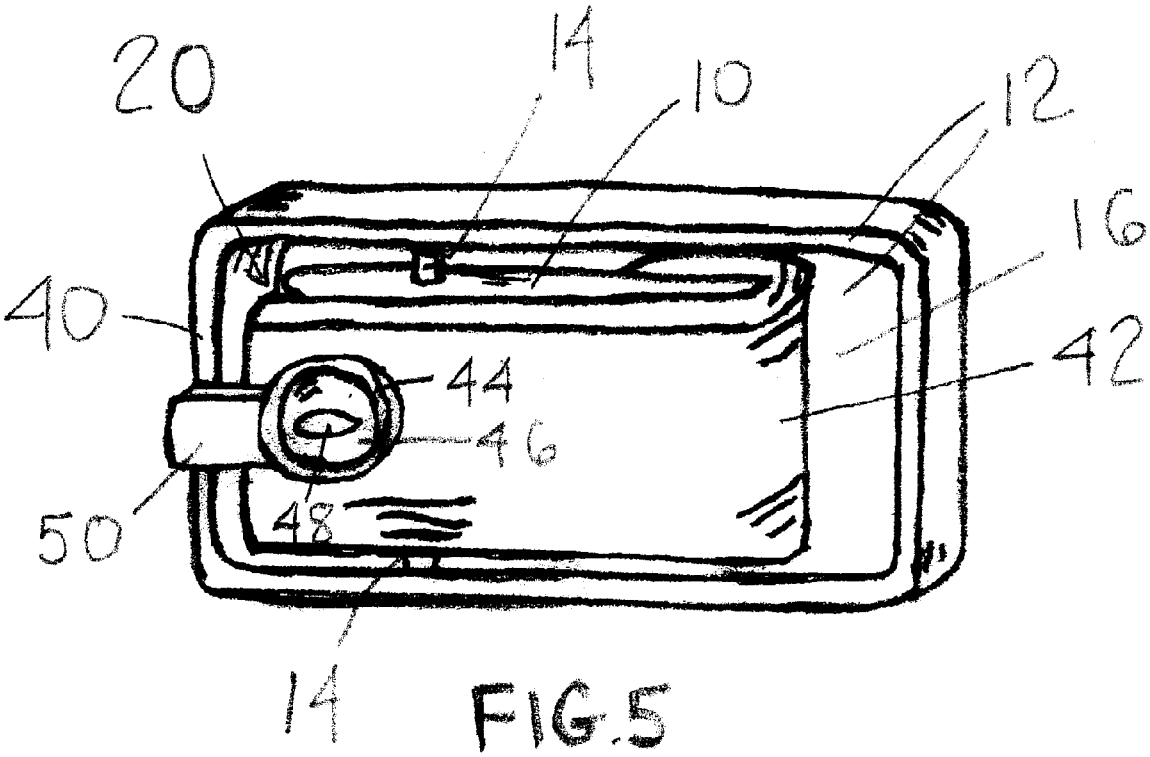

FIG. 5 is a perspective view of an alternate embodiment of the invention with a lock cylinder mounted on a "J" shaped door handle mounting plate. The "J" shaped door handle mounting plate is designed for receipt on a front of the door handle and a portion of the rear of the door handle. A key has been used in the lock cylinder to rotate a lock bolt. The lock bolt has overlapped a front portion of a frame of the door handle housing, thus preventing the movement of the door handle.

Figure 6:
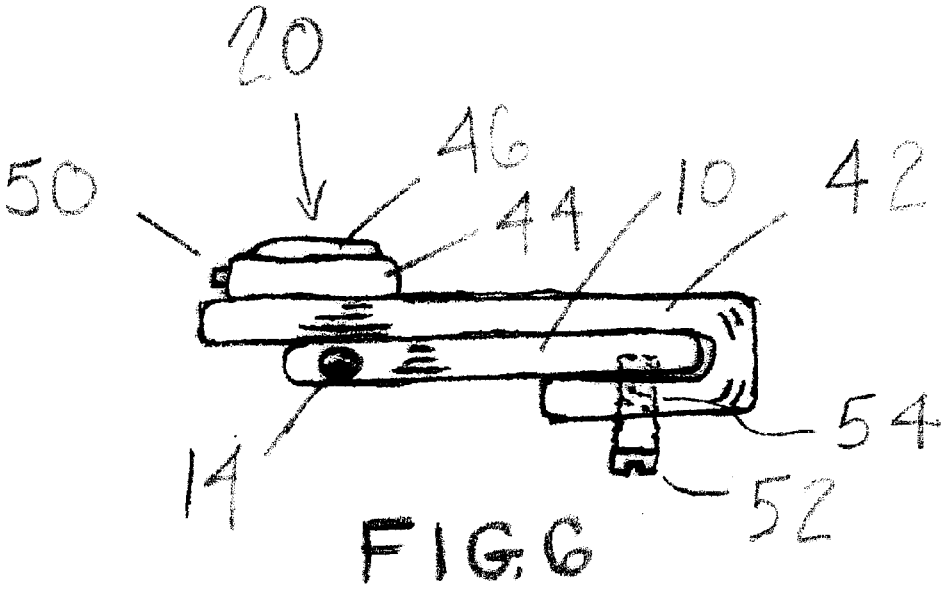

FIG. 6 is a bottom view of the alternate embodiment "J" shaped door handle mounting plate and the door handle.

REFERENCE NUMERALS IN DRAWINGS

10 Hinged Lever-Style Handle
12 Door Handle Housing
14 Handle Rotation Pin
16 Accessible End Of Hinged Lever-Style Handle
18 Inaccessible End Of Hinged Lever-Style Handle
20 Door Handle Lock
22 Lock Cylinder Block
24 Lock Cylinder
26 Front Of Lock Cylinder Block
28 Rear Of Lock Cylinder Block
30 Sides Of Lock Cylinder Block
32 Lock Face
34 Key Slot
36 "L" Shaped Lock Cam
38 Block Guide Pins
40 Frame Of Door Handle Housing
42 "J" Shaped Door Handle Mounting Plate—Alternate Embodiment
44 Lock Cylinder—Alternate Embodiment
46 Lock Face—Alternate Embodiment
48 Key Slot—Alternate Embodiment
50 Lock Bolt—Alternate Embodiment
52 Set Screws—Alternate Embodiment
54 Opening In Rear Portion Of Mounting Plate—Alternate Embodiment

DESCRIPTION AND OPERATION—MAIN EMBODIMENT

Figure 1:
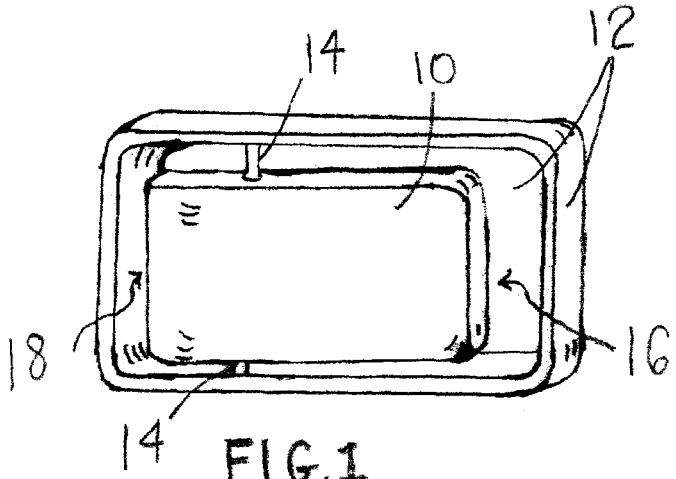
FIG. 1 is a perspective view of a type of handle to which the subject invention applies, herein referred to as a hinged lever-style door handle.

In FIG. 1, a perspective view is shown of a type of door handle to which the subject invention applies, herein referred to as a hinged lever-style door handle. A hinged lever-style handle 10 is shown housed within a door handle housing 12. A handle rotation pin 14 passes through the handle and has ends held in place within the door handle housing 12. The handle rotation pin 14 acts as a hinge for the handle 10, allowing the handle to pivot along the axis of the handle rotation pin 14. The handle 10 is used to open the door by inserting fingers behind an accessible end 16 of the hinged lever-style handle 10 and then pulling the handle 10 outward from the door handle housing 12. This causes the hinged lever-style handle 10 to pivot along the axis of the handle rotation pin 14. Though it is not the purpose here to teach the design and operation of the door handle, suffice it to say that movement of the door handle 10 causes the door latch to open. The means by which the operation of the door handle causes the latch to open is due, in part, to a rod which is connected to the back of the handle toward an inaccessible end 18 of the lever-style handle 10. Typically, this rod extends through an inaccessible hole in the door handle housing and connects to other components whose movement causes the door latch to open.

Figure 2:
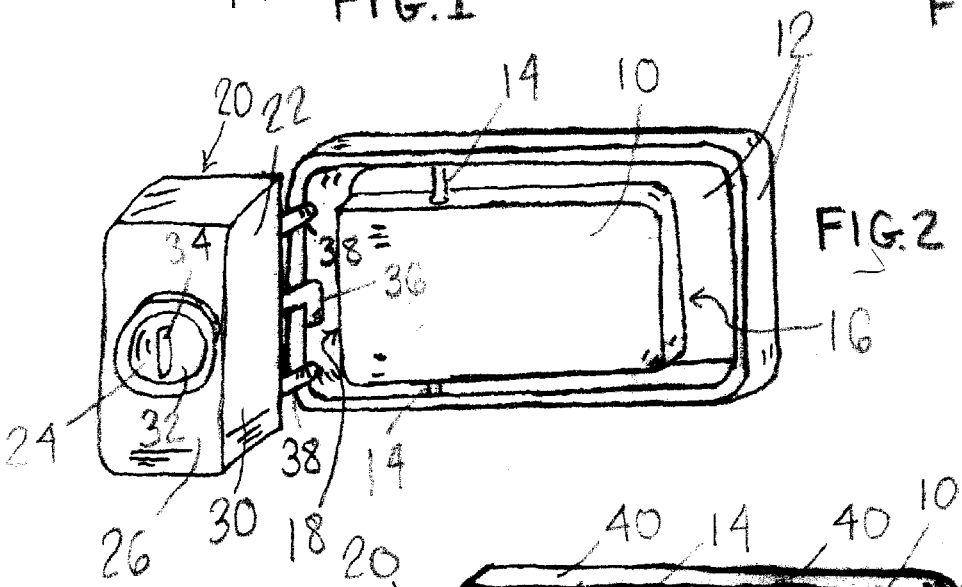
FIG. 2 is a perspective view of the door handle lock with a lock cylinder block and a lock cylinder mounted therein. The door handle lock is shown positioned for engaging a front portion of a hinged lever-style door handle and overlapping a portion of a door handle housing.

In FIG. 2, a perspective view of the subject door handle lock is shown having general reference numeral 20. The door handle lock 20 includes a lock cylinder block 22 with a lock cylinder 24 centered on the block 22 and mounted therein. The block 22 includes a front 26, a rear 28 and sides 30. The rear 28 of the block 22 is shown in FIG. 4. The lock cylinder 24 includes a lock face 32 with a key slot 34 for receiving a lock key. The lock key is not shown in the drawings. The lock face 32 is disposed in the front 26 of the lock cylinder block 22. Also, the lock cylinder 24 includes an "L" shaped lock cam 36 extending outwardly from the rear 28 of the lock cylinder block 22. While the "L" shaped cam 36 is shown in FIGS. 2–4, it is recognized that different types and configurations of cams can be used equally well for engaging and securing the subject lever-style door handle 10 to the door handle housing 12. The lock cylinder block 22 includes a pair of block guide pins 38 extending outwardly from the rear 28 of the block and disposed on opposite sides of the lock cam 36.

In FIG. 3, another perspective view of the door handle lock 20 is shown. In this drawing, the lock cylinder block 22 is shown with the rear 28 of the block secured against a portion of the hinged lever-style door handle 10 and overlapping a portion of the frame 40 of the door handle housing 12.

In operation, once the lock cam 36 and block guide pins 38 have been inserted into the inaccessible end 18 of the handle, the key is received in the key slot 34 and turned, rotating internal workings of the lock cylinder 24 causing the "L" shaped lock cam 36 to rotate 90 degrees, thus engaging a portion of the back side of the door handle 10 and holding the lock cylinder block 22 against the hinged lever-style door handle 10 and overlapping the frame 40 of the door handle housing 12. The lock cam 36 is shown in dotted lines in FIG. 3. With the lock cylinder block 22 held in place, the door handle 10 is prevented from pivoting and allowing the door to be opened.

In FIG. 4, a side view of the lock cylinder block 22 is shown with the two block guide pins 38 extending outwardly from the rear 28. In operation, the two guide pins 38 and the lock cam 36 are inserted into a small channel between the door handle 10 and the door handle housing 12 at the inaccessible end 18 of the handle 10. The guide pins 38 serve to prevent twisting or rotation of the lock cylinder block 22 once it has been locked into position. Also shown is the lock cylinder 24 in dotted lines with the lock cam 36 at the rear of the block 22. The lock face 32 is shown mounted in the front 26 of the block 22.

DESCRIPTION AND OPERATION—ALTERNATE EMBODIMENT

In FIG. 5, a perspective view of an alternate embodiment of the subject door handle lock 20 is shown. In this embodiment, the door handle lock 20 includes a "J" shaped door handle mounting plate 42. The "J" shaped mounting plate 42 is designed for receipt on the front of the lever-style door handle 10, around the accessible end 16 of the door handle 10 and a portion of the rear of the door handle. A lock cylinder 44 with a lock face 46 and a key slot 48 is used for receiving a lock key. The lock key is not shown in the drawings. The lock key is used for receipt in the internal workings of the lock cylinder 44 and moving a lock bolt 50 outwardly therefrom. In operation, when a key is positioned in the key slot 48 and rotated, internal workings of the lock cylinder 44 cause the lock bolt 50 to extend outward overlapping a portion of the frame 40 of the door handle housing 12. In the extended position, shown here, the lock bolt 50 prevents the handle 10 from pivoting and consequently the door from opening.

In FIG. 6, a bottom view of the alternate embodiment of the subject door handle lock is shown, illustrating a means of attaching the "J" shaped door handle mounting plate 42 to the door handle 10. A pair of threaded set screws 52 are used for receipt through an opening 54 in a rear portion of the mounting plate 42 and against a back side of the door handle 10. Only one of the set screws is shown in the drawing. Obviously, the set screws are used for securing the mounting plate 42 to the door handle 10. To install the mounting plate 42, with the handle 10 pivoted outward the mounting plate 42 is inserted over the handle 10 and the set screws 52 are threaded through the opening 54 in the mounting plate 42 and tightened against the rear of handle 10. While the handle is pivoted outward, the screws may be accessed and tightened with an "L" shaped screwdriver. Once the handle 10 has been locked in place, access to the set screws 52 is blocked by the door handle housing 12, thus preventing anyone from removing the handle lock 20 when it is in the locked position. In this figure, the lock bolt 50 is shown in the retracted position.

CONCLUSION, RAMIFICATIONS, AND SCOPE

Thus the reader will see that the door handle lock of the invention provides a rugged economical device for locking a door equipped with a hinged lever-style door handle, by rendering the handle immovable. The door handle lock is simple in design and is easy and quick to install. It can function either as a removable device or can be permanently affixed to the door handle.

While the above description contains many specificities, these should not be construed as limitations on the scope of the invention, but rather as exemplification of embodiments thereof. Two embodiments have been presented illustrating how the door handle lock can be either removable or permanently affixed to the door handle. In the preferred embodiment, the door handle lock is removable and the act of locking the device also affixes it to the door handle. In the alternate embodiment, the door handle lock can be permanently affixed to the door handle using set screws. In this latter embodiment, the act of locking the device serves only to render the handle immovable.

Three important characteristics of the door handle lock are that it attaches to a hinged lever-style door handle, can be positioned such that a portion of the device is held against and overlapping the door handle housing, and can be locked in this overlapping position.

Each piece described within the aforementioned embodiments could be changed in form in ways that would not affect its function. For example, instead of a key locking mechanism, a combination lock or magnetic card lock could be used with equal effectiveness. As another example, the locking cam described herein as "L" shaped could be any of a number of other shapes as long as the rotation of the cam positions a portion of it behind and held against the rear of the door handle.

Accordingly, the scope of the invention should be determined not by the embodiments illustrated, but by the appended claims and their legal equivalents.

What is claimed is:

1. A door handle lock for a hinged lever-style door handle, adapted for mounting on a portion of said hinged lever style door handle and overlapping a portion of a door handle housing, said door handle housing, with said hinged lever style door handle, is received in a portion of a door, said hinged lever-style door handle used for opening said door, said door handle lock comprising:

(a) in combination, a lock cylinder block having a front, a rear, and sides; a means for securing said lock cylinder block to said hinged lever-style door handle; and a means for causing a portion of said door handle lock to be held against and overlap a portion of said door handle housing, (b) in combination, a lock cylinder mounted inside said lock cylinder block, and a locking means to either rotate said lock cylinder or to lock said lock cylinder in position such that said lock cylinder cannot be moved relative to said lock cylinder block.

2. The door handle lock of claim 1 wherein said means for securing said lock cylinder block to said hinged lever-style door handle consists of:

(a) an "L" shaped cam attached to and extending from a rear of said lock cylinder, a portion of said "L" shaped cam being able to rotate behind a portion of said hinged lever-style door handle when said locking means is used to rotate said lock cylinder, (b) at least one block guide pin extending from said rear of said lock cylinder block and positioned between an end of said hinged lever-style door handle and a portion of said door handle housing, said block guide pin preventing any ability to rotate or pivot said lock cylinder block, once said "L" shaped cam'has been locked behind said portion of said hinged lever-style door handle.

3. The door handle lock of claim 1 wherein said means for causing a portion of said door handle lock to be held against and overlap a portion of said door handle housing is accomplished by a shape of said lock cylinder block, said lock cylinder block being dimensioned such that once locked in position against said hinged lever-style door handle, a portion of said lock cylinder block overlaps and is held against said door handle housing.

4. The door handle lock of claim 1 wherein said means for securing said lock cylinder block to said hinged lever-style door handle consists of, in combination:

(a) a "J" shaped mounting plate onto which said lock cylinder block has been mounted, said "J" shaped mounting plate adapted for receipt on a front of said hinged lever-style door handle, around one end of said hinged lever-style door handle, and a portion of a rear of said hinged lever-style door handle, (b) one or more set screws received through one or more threaded holes in a rear of said "J" shaped mounting plate and tightened against a rear of said hinged lever-style door handle.

5. The door handle lock of claim 4 wherein said means for causing a portion of said door handle lock to be held against and overlap a portion of said door handle housing consists of a locking bolt attached to said lock cylinder, said locking bolt being extended and positioned over said door handle housing when said lock cylinder is in a locked position and being retracted away from said door handle housing when said lock cylinder is in an unlocked position.

* * * * *